US007328668B2

(12) United States Patent
Guerard

(10) Patent No.: US 7,328,668 B2
(45) Date of Patent: Feb. 12, 2008

(54) HYBRID VEE-HULL / WING-IN-GROUND EFFECT VESSEL

(75) Inventor: Roger Gamble Doughty Guerard, 24 Escamacu Cir., Saint Helena Island, SC (US) 29920

(73) Assignee: Roger Gamble Doughty Guérard

( * ) Notice: Subject to any disclaimer, the term of this patent is extended or adjusted under 35 U.S.C. 154(b) by 0 days.

(21) Appl. No.: 10/679,534

(22) Filed: Oct. 3, 2003

(65) Prior Publication Data

US 2004/0129192 A1 Jul. 8, 2004

Related U.S. Application Data

(63) Continuation of application No. 60/416,708, filed on Oct. 7, 2002.

(51) Int. Cl.
*B63B 1/32* (2006.01)

(52) U.S. Cl. ..... 114/288; 114/61.33

(58) Field of Classification Search ..... 114/61.1, 114/61.33, 62, 67 A, 271, 283, 288, 289, 114/290, 291, 61.26, 61.32
See application file for complete search history.

(56) References Cited

U.S. PATENT DOCUMENTS 1,658,080 A * 2/1928 Ferron ..... 114/290
2,989,939 A * 6/1961 Tatter ..... 114/61.32
4,091,761 A * 5/1978 Fehn ..... 114/290
4,989,534 A * 2/1991 Field ..... 114/289
5,140,930 A * 8/1992 Lund ..... 114/291
5,176,095 A * 1/1993 Burg ..... 114/67 A
5,402,743 A * 4/1995 Holderman ..... 114/62
5,415,120 A * 5/1995 Burg ..... 114/67 A
6,216,622 B1 * 4/2001 Lindstrom et al. ..... 114/61.33
6,526,903 B2 * 3/2003 Robinson et al. ..... 114/288

* cited by examiner

*Primary Examiner*—Lars A. Olson

(57) ABSTRACT

An improved planing hull which incorporates a vee-bow (1) with outboard chines (2) designed to trap air and water between said chines. As the chines (2) extend aft they become wider and deeper (3) in the water. The vee-bow (1) ensures comfort in a seaway by deflecting waves down and outward and prohibits the bow from being buried in a wave. The outboard chines (2) can house engines and waterjets while providing buoyancy aft to match the displacement of the machinery. The chines (2) can be designed to cancel each other's wake, reducing drag and increasing lift on the hull. The resulting vessel can have much greater beam and interior accommodation with the same displacement as a typical planing boat. The hybrid hull has improved wave handling, significantly improved transverse stability, a smoother ride, and notably less draft over convention vee-hull boats.

2 Claims, 6 Drawing Sheets

PROFILE OF A 55-ft SPORT-FISHERMAN WITH WATER JET PROPULSION

BODY PLAN
OF HYBRID VEE-HULL

PROFILE VIEW
OF HYBRID VEE-HULL

PLAN VIEW OF HULL BOTTOM
OF HYBRID VEE-HULL

OPENING BETWEEN OUTBOARD CHINES
OF HYBRID VEE-HULL

UNDERWATER VOLUME DISTRIBUTION
OF HYBRID VEE-HULL

ISOMETRIC BOW PROFILE
OF HYBRID VEE-HULL

ISOMETRIC STERN PROFILE
OF HYBRID VEE-HULL

PROFILE OF A 55-ft SPORT-FISHERMAN
WITH WATER JET PROPULSION

AFT VIEW of 55-ft SPORT-FISHERMAN
SHOWING PRIMARY ENGINE PLACEMENT

PLAN VIEW of 55-ft SPORT-FISHERMAN
SHOWING PRIMARY ENGINE PLACEMENT
AND INTERIOR ARRANGEMENTS

HYBRID VEE-HULL / WING-IN-GROUND EFFECT VESSEL

This patent claims benefit of the provisional patent 60/416,708 filed on Oct. 7, 2002 filed by Roger G. D. Guerard.

BACKGROUND

1. Field of Invention

This invention relates to hybrid vee-hull planing boats incorporating wing-in-ground effect chines, sponsons, or external appendages.

2. Description of Prior Art

Conventional vee-hull planing boats are designed to cut through waves without pounding or slamming but sacrifice speed and transverse stability for comfort. The fineness of the forward vee-section of the hull determines the smoothness of the ride. A narrow vee-section sinks deeper into the water to support the same amount of weight as a wider flatter vee-section. Narrow vee-hulls inherently have increased wetted surface, which ultimately results in increased drag in the water. To balance this effect conventional vee-hulls have a narrow vee-section forward transitioning into a wide flat vee-section aft. Flattening the vee-shape makes conventional vee-hulls more transversely stable and increases attainable high-end speed of the vessel. A narrow forward section helps soften the impact of waves providing a smoother ride when compared to vessels with fuller or blunt forward hull sections.

Conventional planing vee-hulls may have chines. The motion of conventional vee-hulls tends to be transversely tender when planing, as previously stated. A person walking from one side of the boat to the other side causes the vessel to lean from side to side as well. To remedy this the outboard chines are frequently designed into the hull. The chines are narrow, run parallel to the waterline, and are above the centerline vee-section of the hull.

Weight distribution and interior accommodation are challenges in any vessel. The center of gravity of the boat must be located directly over the center of buoyancy of the hull at its designed waterline. If the two centers are not located in the same plane, the boat will trim and list until they are. If there is more weight to one side then the boat will list, lean to that side. If there is more weight aft the boat will trim aft, sit lower in the water by the stern.

To achieve balance, conventional hulls have engines forward from the stern of the vessel. This encroaches on interior space and compromises the comfort of the vessel due to noise and heat from the engine. Also, lines must be run to the engine for cooling, intake air, and exhaust. Exhaust lines become quite hot requiring bulky insulation. An insulated housing is typically fashioned around the engine itself to deaden engine noise and contain heat. The housing significantly reduces the available space for personal accommodation. This type of engine mounting also requires a propeller shaft to run from the engine aft, normally under the boat or inside the hull to a stern drive propeller. If the shaft is under the boat, it is subject to damage should the boat run aground or hit debris in the water. The shaft configuration below the hull produces significant drag lowering the speed of the vessel and increasing operating cost. Both configurations require bearing supports along the shaft length to ensure it turns freely and does not vibrate. Propeller shafts turn at high speeds so vibrations in propeller shafts and shaft alignment with the engine are critical concerns.

Stern drive boats have engines directly coupled to the stern drive through the transom. This keeps the machinery in one location. Engines still encroach on deck space, but noise concerns are less since aft cockpits are normally open spaces and intake air is easily obtainable. To counter the concentration of weight aft, fuel and water tanks are located forward. The distribution of weight must be maintained about the vessel's center of buoyancy or the vessel will trim with her bow up or down. Close inspection of stern drive boats show that they trim aft and sit lower in the water by the stern. If the boat has her bow up, the fine forward entry of the vee-hull is not in the water so the boat will pound in a seaway and it is much more difficult for the driver to see. If the bow trims down then the boat will have a tendency to bury her bow in a seaway. This is critical since full fuel tanks represent significant weight. As the fuel tanks empty the center of weight moves, strongly impacting vessel characteristics and safety. Trim tabs are added to compensate for this design flaw. Trim tabs are attached to a vessel's transom and can be angled to deflect water. When a boat is traveling, trim tabs are adjusted as required to compensate for changing weight distribution.

As boating has matured there are many more boaters on the water and the potential for accidents has dramatically increased. Several accidents have occurred in planing boats when the operator applied full throttle from a dead stop or slow speed. Thrust applied by the propellers is below the hull and induces a strong moment that causes a boat's bow to rise dramatically for a short period of time. When the stern of a boat digs down into the water the bow rises and the driver is temporarily unable to see over the bow. Ski boats and speedboats racing from a start are prime examples of this kind of hazard but the phenomenon is common to all planing boats.

Objects and Advantages

The primary embodiment of this patent is a planing boat hull having a conventional vee-hull forward with enhanced outboard chines. The outboard chines may appear to be conventional when the boat sits at rest in the water, or is not planing. The chines typically originate at the bow above the waterline transitioning as they go aft, ultimately extending below the center vee-hull. The outboard chines also become wider as the chines transition aft. When planing, the proposed boat rides on the outboard chines, lifting the center vee-hull out of the water thereby reducing wetted surface and drag, while enhancing transverse stability. Air trapped between the two chines and the water creates a wing-in-ground effect of buffered air adding lifting forces on the hull and further reducing drag at planing speeds. This lifting force on the hull is augmented by water, which impacts the curved/cupped after sections of the vee-bottom of the hull and is deflected down. A ram air effect is also induced by the changing width of the outboard chines as they transition aft. The distance between the chines is greater in the bow creating a funnel for air. A large volume of air is trapped under the bow of the boat as it planes. This volume of air must remain constant as it goes under the boat. The result of the narrowing gap between the chines, as the chines transition aft, is to create a buffered layer of accelerated air. The buffered layer of accelerated air acts to increase the lift on the boat reducing the hull drag in the water. The present invention has a forward center vee-section of the hull to ensure the boat will not slam or pound in a seaway and additional lift generated by buffered air under the hull ensures a measurably smoother and faster ride. Existing vee-hulls have a higher wetted surface, while planing, creating more drag and providing less lift at speed. Conventional vee-hulls are also notably less transversely stable, and have a rougher ride. In the preferred embodiment of the proposed hybrid boat the centerline vee-hull can become shallower as it transitions aft to further enhance the wing-in-ground effect. An example of this is shown in the 32-foot hull referenced in FIG. 1 through FIG. 7. Another example of the embodiment of this hybrid hull is shown in a 55-foot boat referenced in FIG. 8 through FIG. 10. The 55-foot boat shows engines and water jets installed in the outboard chines. The 55-foot boat does not have the centerline vee-hull elevated as it transitions aft from amidships but the 32-foot boat does.

Fuel and water tanks can be fitted below the deck centered over the vessels design center of buoyancy. Tanks placed in this location will not effect the trim of the vessel regardless of how full or empty the tanks are. The added advantage is that no interior space need be compromised to achieve this placement and safety is further enhanced over conventional vessels. A balance must be made between required buoyancy, outboard chine draft, and outboard chine width. Adjusting these variables allows for fuel and water tanks to be placed over the center of buoyancy. The 32-foot boat design example embodying this patent has 2,200 pounds of fuel when fully loaded. The total displacement of the vessel is 7,500 pounds when fully loaded. Fuel weight represents 30% of the vessel weight when fully loaded. If the fuel were not located over the center of buoyancy the change in fore and aft trim of the boat with fuel consumption would be dramatic. In the 32-foot boat design the center of buoyancy of the hull moves aft 5 inches from full load to light ship draft. This requires the center of the fuel in the fuel tanks to move aft when fuel is consumed. Since the outboard chines get deeper and wider as the chines transition aft a single fuel tank spanning the width of the vessel is easily designed with the proper characteristics.

The outboard chines of the proposed hull can be designed with enough width and depth for the engines and drive systems to be mounted inside them. Interior accommodation need not be encroached upon with the proposed design. The proposed design is ideal for placing water jets in the outboard chines since water jets require a flat surface for water intake. Whether stern drives or water jets are used the lowered aft chines provide buoyancy in the stem where it is needed to offset the machinery weight. Trim tabs are not required to ensure proper trim of the proposed design over a range of drafts and speeds. This enhances the safety and efficiency of the proposed boat hull.

In smaller boats where outboard motors are used the motors can be set inboard of the chines of the proposed hull. The propellers can be safely above the bottom of the boat and have unobstructed water flow. The propellers are protected in a grounding situation since they are above the outboard chines. Also, the propellers always have clean unobstructed water flow, as mentioned, resulting in enhanced performance over hulls which have a small center section of the hull cut away for the propeller to be protected in a grounding situation.

Inherent in this proposed design is the ability to maintain level pitch under acceleration, which dramatically improves safety. Conventional planing hulls initially assume a "bow up" position when the vessel transitions between displacement speed and planing speed. High thrust applied by the propeller deep in the water and far aft creates a moment, which causes conventional boats to raise their bow, usually blocking the sight of the helmsman. The proposed design eliminates this as the energy provided is being countered by increased water velocity to the lower chines at a similar elevation and the forward portion of the vee-hull acts like a cantilevered beam keeping the bow down.

The hull can be optimized for speed and comfort by changing the centerline vee and the outboard chines. The centerline vee section of the hull acts as a shock absorber deflecting waves. The wider the centerline vee section the more buoyancy it provides resulting in a stiffer bumpier ride. Maximizing the depth of the centerline vee also reduces speed but makes the ride smoother. A step can be added to the centerline vee to introduce turbulent flow in the water behind the step enhancing the water and air mixture trapped between the two outboard chines. Adding a step only helps at higher speeds provided the centerline vee is immersed forward of the step. The outboard chines can be made deeper providing a more cushioned but slower ride. The can also be made shallower providing a faster but bouncier ride. The width of the outboard chines is also critical in producing a wake at speed.

The wake produced by the outboard chines and the centerline vee can be optimized to cancel each other at speed ranges just as a bulbous bow does on a ship. Preliminary test shows that it is possible to reduce the wake of the hull configuration by adjusting the after sections of the centerline vee along with the width and depth of the outboard chines. The inboard wake produced by the outboard chines can be canceled by the centerline vee or by each other. The result is to produce a faster more efficient hull over a given range of speeds.

All of the properties of the hybrid vee-hull combine to make it faster and significantly more comfortable boat when compared to existing designs. At low speeds this hull does have increased drag over a flat-bottomed boat but also has much greater transverse stability. At high speeds the increased transverse stability keeps the boat from healing during sharp turns and ensures proper tracking of the hull.

In summary, the primary objects and advantages of the hybrid vee-hull in the present invention are:

a) A centerline vee-section forward to cut through seas reducing hull slamming loads and providing directional stability coupled with outboard chines.

b) Outboard chines extending below the centerline vee-section aft wide enough to provide lift at speed.

c) The outboard chines may be narrower forward increasing in width as the chines transition aft. This creates a funnel or ram air effect adding to lift on the boat.

d) Water bouncing off the cupped after sections of the centerline vee-hull is pushed back down which creates additional lift on the hull.

e) The outboard chines provide additional transverse stability over conventional hulls.

f) Air trapped between the outboard chines and the water creates a wing-in-ground effect where buffered air raises the boat out of the water thereby reducing drag.

g) Design improves weight distribution by adding buoyancy aft where machinery weights are ideally concentrated.

h) Design produces improved pitch stability at all ranges of acceleration. Thrust from the propellers is above the bottom of the outboard chines so the induced pitching moment when accelerating is minimized due to the shorter moment arm distance to the water surface and the large inherent buoyant force aft.

i) Design significantly improves the safety of the vessel as a result of improved stability and visibility by the helmsman in all conditions.

j) Design can house water jets, and in larger vessels primary engines. Both reduce the intrusion of propulsion systems into the personal accommodation spaces and increase the versatility of interior design space.

k) Design results in an extremely shallow hull draft utilizing water jets housed in the outboard chines. This hull can travel over shallow shoals conventional boats would not manage.

l) Design protects propellers during grounding.

m) Design can have increased beam for the same displacement when compared to a typical vee-hull because the outboard chines support the vessel. The added beam allows for increased interior and aft deck space. It also enhances the wing-in-ground effect by providing a larger surface providing lift.

n) Design provides enhanced tracking during turns and reduces healing as a result of the outboard chines.

o) Design can be optimized to produce less wake at speed through "wake canceling" providing less drag over conventional hulls.

Further objects and advantages achieved with the advent of this invention will become apparent from a consideration of the drawings and ensuing description.

DRAWING FIGURES

FIG. 1 includes a body plan drawing typical in naval architecture for describing a hybrid-vee hull accompanied by a rendering from a bow perspective.

Figure 8:
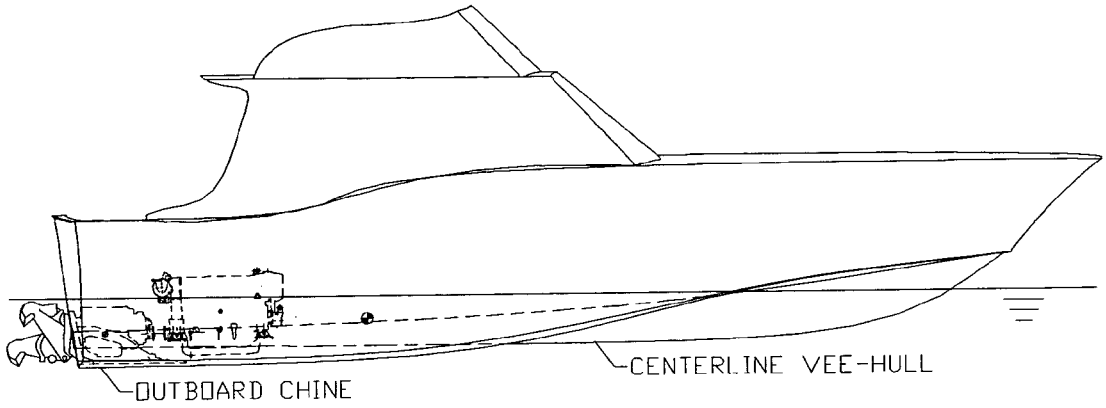
Figure 9:
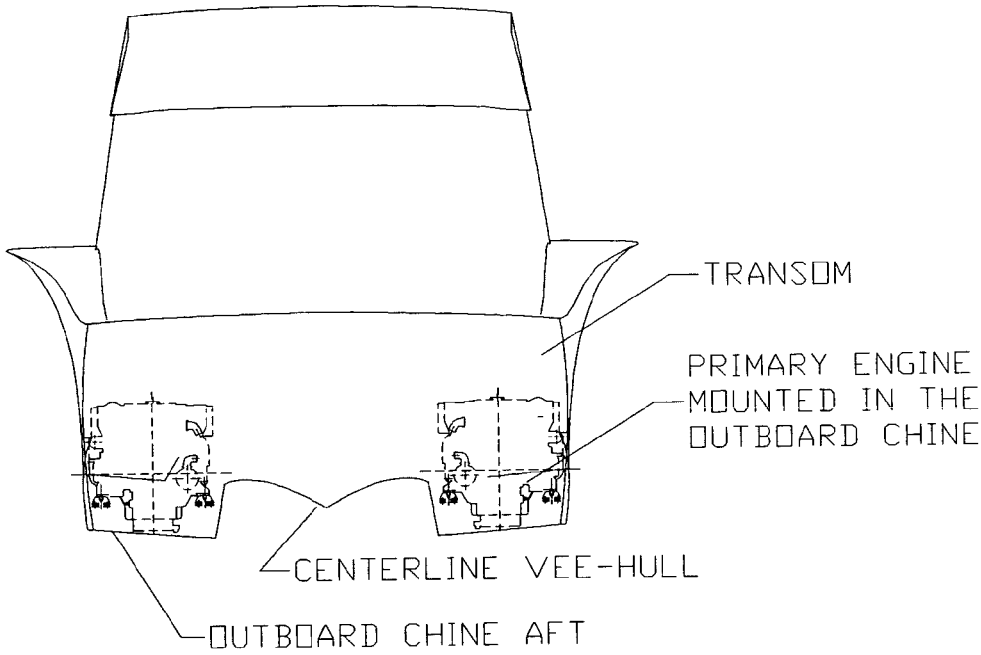
Figure 10:
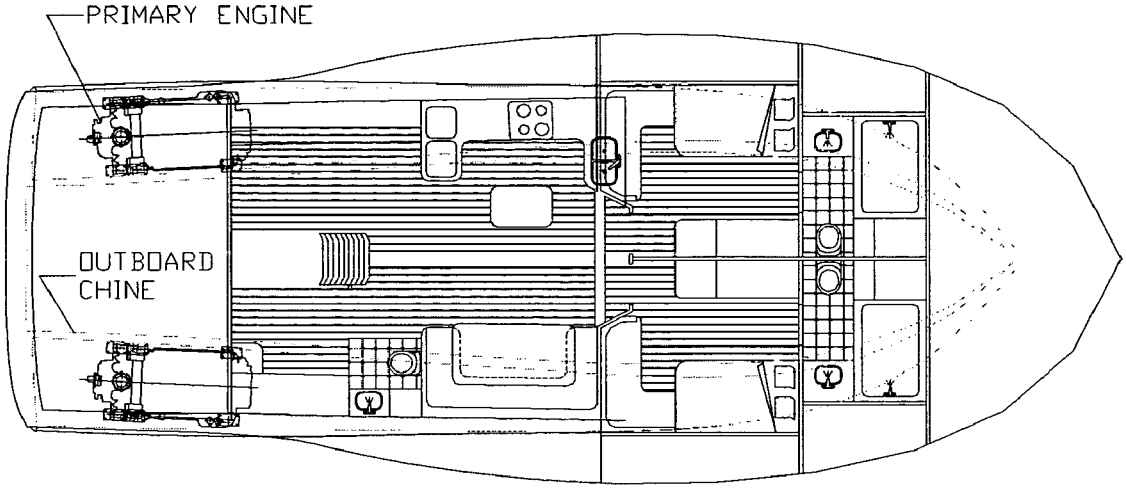

FIGS. 8, 9, and 10 show a hybrid vee-hull with the primary engines housed inside the outboard chines and mounted to waterjets through the boats transom.

REFERENCE NUMERALS IN DRAWINGS

The primary components are listed below:

| Item Number | Nomenclature |
|---|---|
| 1A | Centerline Vee-Hull Port |
| 1B | Centerline Vee-Hull Stbd |
| 2A | Outboard Chine Inner Side Port |
| 2B | Outboard Chine Inner Side Stbd |
| 3A | Outboard Chine Bottom Port |
| 3B | Outboard Chine Bottom Stbd |
| 4A | Freeboard Port |
| 4B | Freeboard Stbd |
| 5 | Transom |

DESCRIPTION OF PATENT ART

Figure 1:
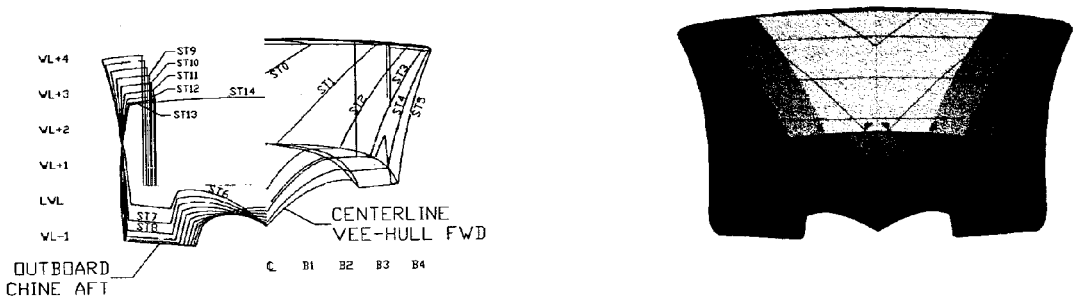
Figure 2:
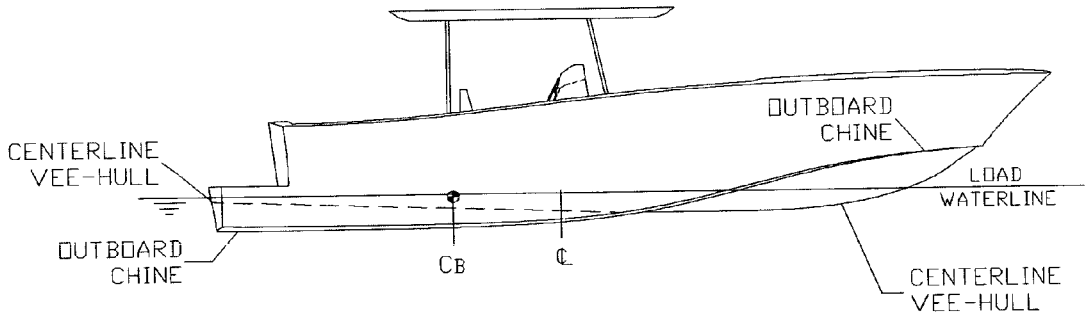
FIG. 2 is a profile view of the hybrid-vee hull showing a deep-vee bow and outboard chines. The deep-vee bow becomes shallower as it transitions aft while the outboard chines become significantly deeper as they transition aft.

An example of a 32-foot Sport-fisherman vessel is provided. The body plan shown in FIG. 1 illustrates the outboard chines' transition below the centerline vee-section of the hull. The transition of the chines from above the centerline vee-hull forward to below the centerline vee-hull aft is made clearer in FIG. 2 showing the profile of the vessel. Note that the centerline vee-hull is at its deepest point forward of amidships, the middle of the boat, and transitions to a much shallower depth at the transom. This transition may be required to ensure proper buoyancy distribution as well as enhancing the wing-in-ground effect created by air trapped between the outboard chines. Alternately the centerline vee-hull may remain at a fixed depth with the outboard chines extending below the centerline vee-hull in the aft sections.

Figure 3:
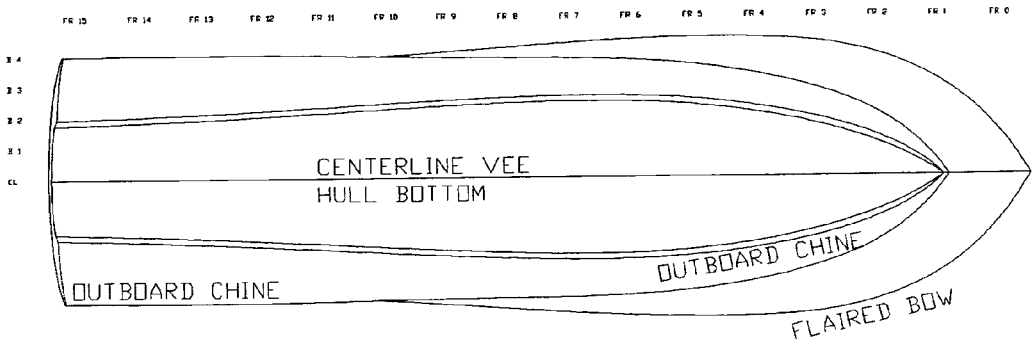
FIG. 3 is a view of the hull bottom illustrating a notable increase in width of the outboard chines as they transition aft.

The notable increase in width of the outboard chines as they transition aft, shown in plan view of hull bottom (FIG. 3 and in FIG. 4), coupled with the increased depth in the water provide increased transverse stability over conventional vee-hull vessels. Note that the chines can have a flat bottom or an angled bottom, either inboard or outboard. The example shown is angled deeper as the chine moves inboard. The inboard angle of the chine increases the wing in ground effect during planing without impairing the vessel during turns. The opposite angle, an outboard angle, will provide a similar effect but in higher performance vessels this can create some difficulty in turning at speed. In high performance hulls, turning can be improved by adding to the deeper portion of the chine a small second upward angle or an arc. This will allow water to flow under or around the chine more easily and prevent "hobby horsing" of the hull in turns.

Figure 4:
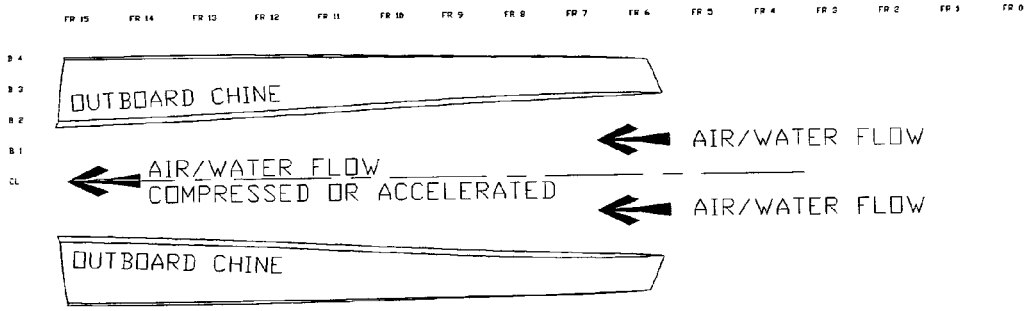
FIG. 4 shows the planing area of the hybrid vee-hull and the open space between the outboard chines that traps air and water to generate lift on the hull.

FIG. 4 shows the flow of water and air trapped between the outboard chines. Because the outboard chines increase in width as they transition aft, the open volume between the outboard chines decreases. Air and water passing between the chines must be compressed or accelerated as a result of the reduced open volume. The result is to increase lift on the hull, which reduces drag.

The combined advantages of increased stability, lift on the hull, and accelerated fluid flow between the outboard chines, dramatically increase the attainable speed of the hull and comfort for the passengers. The hybrid vee-hull design represents a significant advance in the technology of planing vessels.

Figure 5:
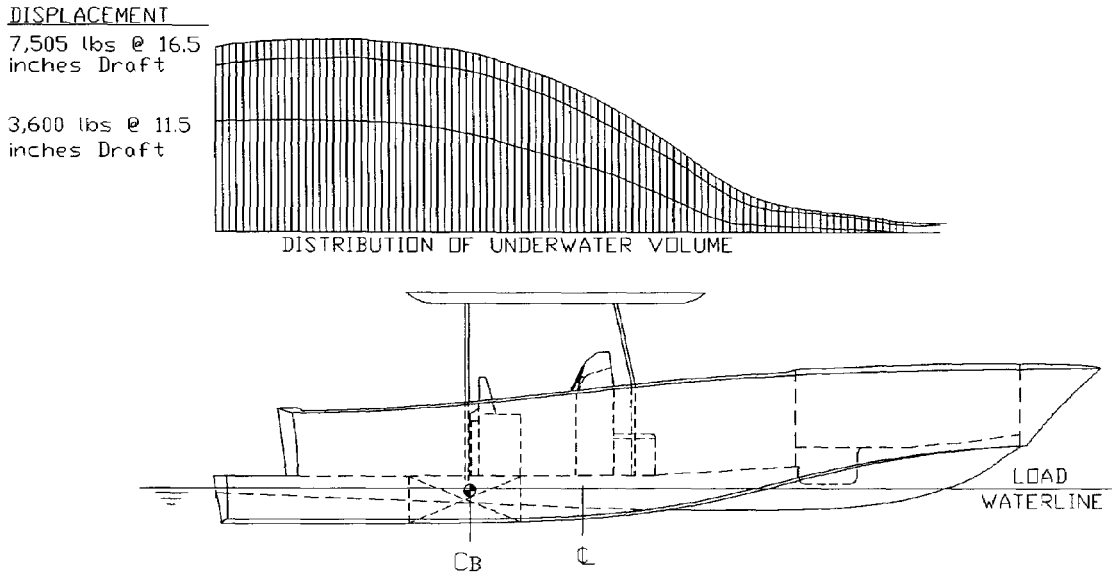
FIG. 5 illustrates the distribution of buoyancy along the length of a hybrid vee-hull designed to match the distribution of machinery weight concentrated in the aft portion of the vessel.

The distribution of underwater volume shown in these figures is accommodated by machinery weight and the weight of the hull itself. A profile view with general arrangements of the 32-ft sport-fisherman is shown in FIG. 5. The graph above the hull represents the distribution of underwater volume of the hull. The large amount of underwater volume aft offsets the weight of the engines, fuel, and outfitted hull.

Figure 6:
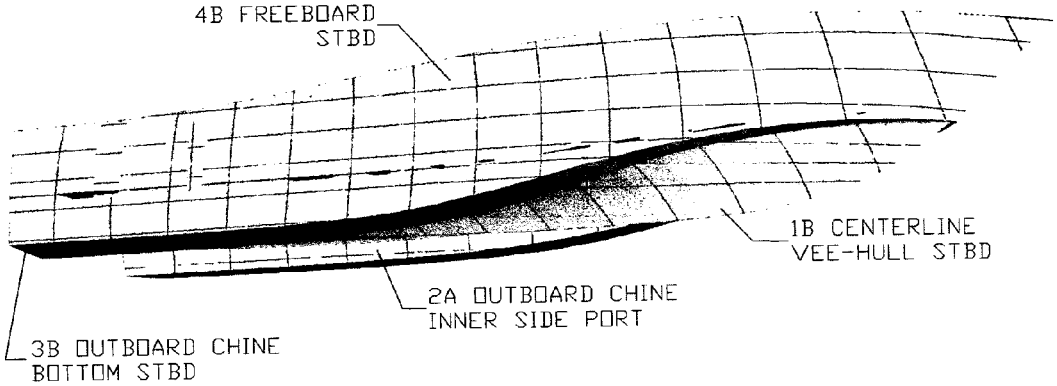
FIGS. 6 and 7 are isometric views of a hybrid vee-hull containing reference numerals identifying each part of the hull.
Figure 7:
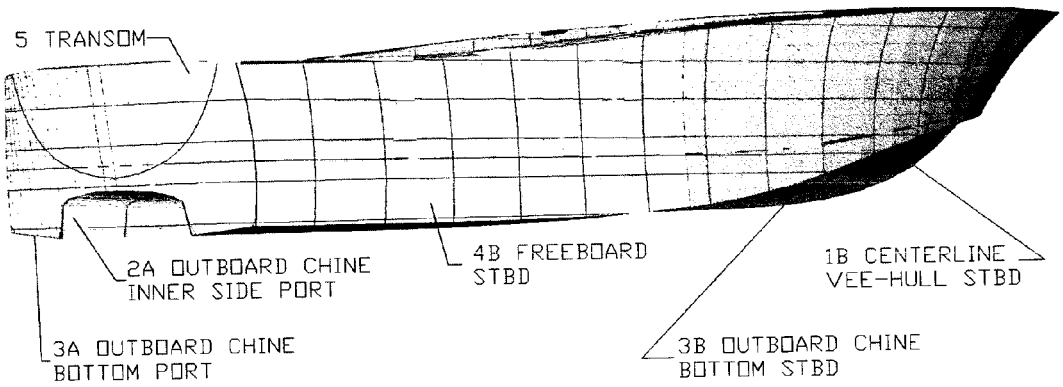

FIG. 6 and FIG. 7 show a 32-foot Sport-fisherman representing a preferred embodiment of the proposed hull design. The hull is typically made of components that are symmetric about the hull centerline, port (left) and starboard (right).

A description of one side of the vessel is provided for the sake of simplicity. The hybrid vee-hull consist of a centerline vee hull, item 1. The centerline vee-hull, item 1, attaches to an outboard chine inner side, item 2. The outboard chine inner side extends down below the centerline vee-hull as it transitions aft. The outboard chine inner side, item 2, attaches to an outboard chine bottom, item 3. The outboard chine bottom is narrow in the bow but becomes wider as it transitions aft. The outboard chine bottom, item 3, attaches to the side of the vessel, item 4 freeboard. The transom of the vessel, item 5, is the aftmost part of the boat and is connected to all of the other items, 1-4. All of the parts connect to make a watertight hull.

The sport-fisherman in FIG. 8 illustrates an installation with the primary engines fitted into the outboard chines. Water jet propulsion is directly coupled to the primary engines. Note that the outboard chines extend below the centerline vee-hull. The centerline vee-hull remains at its lowest elevation as it extends aft. This is different from the 32-ft Sport-fisherman because of the increased weight of the engines and hull requires more underwater volume, buoyancy, aft to support them.

The aft view shown in FIG. 9 illustrates the width of the outboard chine aft and shows a properly sized primary engine fitted inside the outboard chine. The wing-in-ground effect characteristics remain but the centerline vee-hull is not elevated as it goes aft as already noted. The ability of this vessel to maneuver in a seaway is enhanced by the centerline vee-hull maintaining a small amount of vee shape. The outboard chines still account for greatest portion of volume aft and the vessel has increased transverse stability as a result.

The plan view shown in FIG. 10 further illustrates the width of the outboard chines and the primary engine placement. The aft deck of the vessel houses the engines without encroaching on interior space. The design allows the vessel to have a greater beam, width, than would normally be practical from a sea-keeping perspective. The added width increases available interior space and provides more living space while improving the vessel's stability and ability to smoothly cut through offshore seas. Weight of the engines is kept low in the hull adding to overall vessel stability and the centerline vee-hull ensures slamming or pounding in waves is kept to a minimum. Compared to a similar sized vessel the proposed hybrid hull has improved performance as described in this patent, shallower draft, increased interior space, and improved comfort both in ride, and insulation from the engines with respect to sound and heat. Direct comparison with a typical existing vessel shows the embodied hybrid vee-hull has notably reduced draft and increased beam wile maintaining similar displacement:

COMPARISON OF AN EXISTING VESSEL WITH THE HYBRID VEE-HULL

| | Bertram 54 Convertible | Hybrid Vee-hull 55 |
|---|---|---|
| Length | 54-ft | 55-ft |
| Beam | 16-ft 11-in | 22-ft |
| Draft | 5-ft 2-in | 3-ft 6-in |
| Displacement | 75,400-lbs | 74,680-lbs |

The difference in draft and beam are notable. The ramifications of the differences are significant. The Hybrid Vee-hull is capable of traveling in significantly less water and has dramatically increased interior space. The shallower draft greatly increases the range of the vessel. The hybrid vee-hull is also capably of traveling faster and more comfortably with the same power. The added beam of the hybrid vee-hull provides significantly more transverse stability, which reduces motions and dramatically increases the safety of the vessel.

SUMMARY

The hybrid vee-hull has significant improvements over conventional vee-hulls in stability, performance, and accommodation. The hybrid vee-hull has significantly improved transverse stability inherent in the added width of the outboard chines and increased possible width of the hull. Increased lift on the hull provides a smoother ride and greater obtainable speed as a result of the wing-in-ground effect, which is augmented by the shape of the outboard chines. The centerline vee-hull ensures good motions in a seaway. Maintaining proper fore and aft balance, regardless of fuel level, is designed into the hull by adjusting the width and depth of the chines coupled with the centerline vee-hull, taking into account engine weight and placement. During rapid acceleration the hybrid vee-hull tends to remain level adding safety by not restricting the drivers view which is not true of conventional planing hulls. The outboard chines can be designed to cancel their wake further reducing drag on the hull and increasing speed. Additional items such as trim tabs are not required to achieve proper balance representing a savings in cost and reducing the complexity of the vessel. Inboard engines can be fit into the hybrid vee-hull outboard chines and can be adjacent to stern drives consolidating machinery space while preserving interior and accommodation space. Also, interior space can be increased while providing improved performance. Other advantages may present themselves once the design begins production.

The invention claimed is:

1. A hull for conveyance across a fluid, comprising a central hull having a deep vee bow section and a buoyant forward section, and outboard chines which extend below said central hull to provide a means to trap air, water, or a mixture of air and water to provide lift to said hull, where said outboard chines provide buoyancy to said hull, and said outboard chines are designed as a means for housing water jets or other propulsion drives.

2. The hull of claim 1, where said outboard chines are designed as a means to produce stern wake canceling effects.

* * * * *